US011147322B1

(12) United States Patent
Cougar

(10) Patent No.: US 11,147,322 B1
(45) Date of Patent: Oct. 19, 2021

(54) ALTERNATIVE NOSE AND MOUTH MASKS

(71) Applicant: Alex Cougar, Detroit, MI (US)

(72) Inventor: Alex Cougar, Detroit, MI (US)

( * ) Notice: Subject to any disclaimer, the term of this patent is extended or adjusted under 35 U.S.C. 154(b) by 0 days.

(21) Appl. No.: 17/194,121

(22) Filed: Mar. 5, 2021

(51) Int. Cl.
*A41D 13/11* (2006.01)
*A62B 23/02* (2006.01)

(52) U.S. Cl.
CPC ..... *A41D 13/1176* (2013.01); *A41D 13/1115* (2013.01); *A41D 13/1192* (2013.01); *A62B 23/025* (2013.01)

(58) Field of Classification Search
CPC ..... A41D 13/11–1146; A41D 13/1161–1176; A41D 13/1192; A62B 23/00–025; A62B 23/06; A62B 7/10; A61M 16/0683–0688
See application file for complete search history.

(56) References Cited

U.S. PATENT DOCUMENTS 3,695,265 A * 10/1972 Brevik ..... A41D 13/1176 128/206.14
4,240,420 A * 12/1980 Riaboy ..... A41D 13/1176 128/206.14
6,083,602 A * 7/2000 Caldwell ..... D06N 3/0002 428/138
6,196,223 B1 3/2001 Belfer et al.
7,044,127 B1 * 5/2006 Fernandez DeCastro ..... A41D 13/11 128/202.15
7,152,601 B2 12/2006 Barakat et al.
8,430,098 B1 4/2013 Buddharaju
2004/0231023 A1 * 11/2004 Huang ..... A41D 13/1176 2/9
2005/0098182 A1 * 5/2005 Callan ..... A41D 13/11 128/206.19
2008/0110469 A1 5/2008 Weinberg
2009/0133700 A1 * 5/2009 Martin ..... A62B 18/10 128/207.12
2016/0121144 A1 * 5/2016 Hyde ..... A62B 23/025 128/206.11
2016/0128873 A1 * 5/2016 Martin ..... A61K 31/00 604/360
2017/0106217 A1 * 4/2017 Kuhn ..... A41D 13/1161
(Continued)

OTHER PUBLICATIONS

Hawley, Video Tutorial: No-Strap Face Mask for Haircuts, www.lazygiridesigns.com, 2020.

*Primary Examiner* — Rachel T Sippel

(57) ABSTRACT

An alternative nose and mouth mask allows a user to protect their respiratory inhalations and filter respiratory exhalations, thus reducing the likelihood of the spread of diseases. The apparatus forms a preferably adhesive seal over the user's mouth and nose separately, thus preventing passing of contaminated air between a user's mouth and nose. Many current mask designs, when worn, tend to make the wearer appear less trusting and less human, creating an illusion that results in perception of the mask as a disguise. The apparatus maximizes the amount of visible skin, thus mitigating the disconcerting effects of mask wearing. Furthermore, the apparatus may provide a medicated layer, which may be helpful in assisting users recover from a variety of potential respiratory ailments. A waterproof outer layer prevents damage due to wear and moisture buildup as well as potential damage due to poor weather conditions.

9 Claims, 7 Drawing Sheets

(56) References Cited

U.S. PATENT DOCUMENTS

| | | | | |
|---|---|---|---|---|
| 2018/0133524 | A1* | 5/2018 | Jang | A62B 23/06 |
| 2019/0336895 | A1* | 11/2019 | Inoue | A41D 13/11 |
| 2020/0085124 | A1* | 3/2020 | Chiang | A41D 31/325 |
| 2020/0330957 | A1* | 10/2020 | Maanum | A62B 23/02 |
| 2020/0397087 | A1* | 12/2020 | Crenshaw | A41D 13/113 |
| 2021/0031061 | A1* | 2/2021 | Cooper | A41D 13/11 |

* cited by examiner

ALTERNATIVE NOSE AND MOUTH MASKS

FIELD OF THE INVENTION

The present disclosure relates generally to face masks. More specifically, the present disclosure describes alternative nose and mouth masks.

BACKGROUND OF THE INVENTION

The fear of the Coronavirus as a mass killer around the world appears and reappears daily in our global news media, while the mass public scrambles for available masks that cover both their noses and mouth as protection against the virus getting into our airways. The purpose of wearing a mask is to stop virus getting into the airway. The Coronavirus is a tiny organism that can penetrate any possible openings. There are different models of the masks for use during the era of Coronavirus is a staple to buy and wear. While the industries and manufacturers are concerned mostly in making money from selling the mask with devoid unconcerned effort towards if the mask serves the purpose of protecting against the virus.

Many believe the current mask designs, when worn, make the wearer appear less trusting and less human, and creates the fear of the unknown as if the mask is disguise. The public attaches the same fear of others, apprehension, uncomfortability ascribed to those who wear a veil or burqa for religious and/or cultural reasons. The mask leaves no clue or idea of assurance to the identity of the person under the mask and this often ill-affects passersby and can lead to strained interactions and can be construed as an affront—particularly in democratic societies. People become disdained, disgusted, and uncomfortable with masks to the extent of neglecting to wear them despite a being necessary scientific requirement.

BRIEF DESCRIPTION OF THE DRAWINGS

Some of the embodiments will be described in detail, with reference to the following figures, wherein like designations denote like members, wherein.

Figure 1:
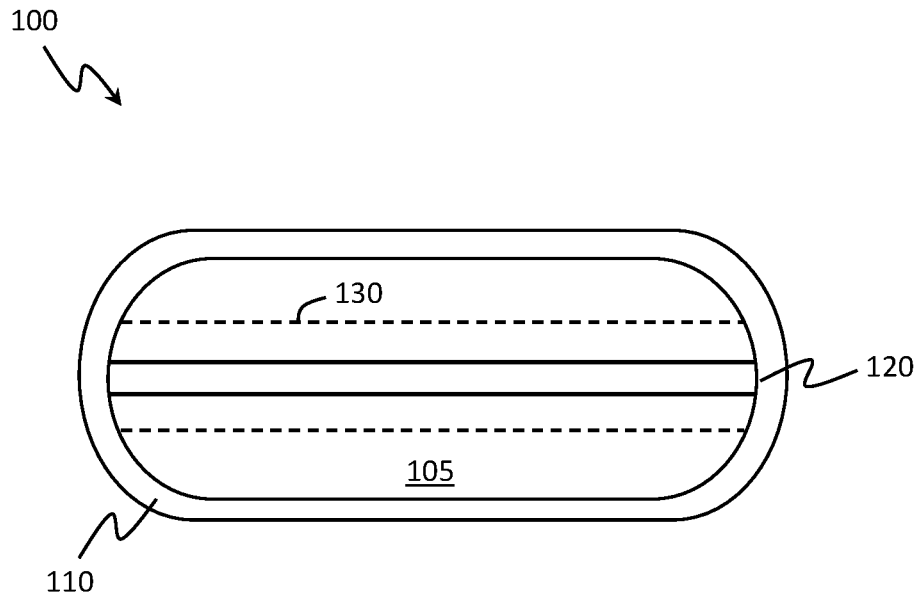
FIG. 1 illustrate a front view of a face mask having a support element, according to some embodiments.

Unless otherwise specifically noted, articles depicted in the drawings are not necessarily drawn to scale. All illustrations of the figures are for the purpose of describing selected version of the present disclosure and are not intended to limit the scope of the present disclosure.

DETAIL DESCRIPTIONS OF THE INVENTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods.

Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "dorsal" refers to positions that are located near, on, or towards the upper or top side of a structure.

The present disclosure includes many aspects and features. Moreover, while many aspects and features relate to, and are described in the context of alternative nose and mouth mask, embodiments of the present disclosure are not limited to use only in this context.

The fear of the Coronavirus as a mass killer around the world appears and reappears daily in our global news media, while the mass public scrambles for available masks that cover goth their noses and mouth as protection against the virus getting into our airways. The purpose of wearing a mask is to stop virus getting into the airway. The Coronavirus is a tiny organism that can penetrate any possible openings. There are different models of the masks for use during the era of Coronavirus is a staple to buy and wear. While the industries and manufacturers are concerned mostly in making money from selling the mask with devoid unconcerned effort towards if the mask serves the purpose of protecting against the virus.

Many believe the current mask designs, when worn, make the wearer appear less trusting and less human, and creates the fear of the unknown as if the mask is disguise. The public attaches the same fear of others, apprehension, uncomfortability ascribed to those who wear a veil or burqa for religious and/or cultural reasons. The mask leaves no clue or idea of assurance to the identity of the person under the mask and this often ill-affects passersby and can lead to strained interactions and can be construed as an affront—particularly in democratic societies. People become disdained, disgusted, and uncomfortable with masks to the extent of neglecting to wear them despite a being necessary scientific requirement.

Embodiments of the present disclosure seek to provide face masks that are strapless and may be worn on a user's nose or mouth. Other aspects of the present invention seek to provide face masks that form a gapless seal with the user's skin when worn. Additional aspects of the present invention seek to provide face masks that are washable, breathable, and do not muffle the user's voice. Embodiments of the present disclosure further seeks to provide face masks that are demarcated between the nose and mouth areas of the face mask. Other aspects of the present invention seek to provide face masks that include a medicated nose area to treat the user without contaminating the user's mouth. The instant disclosure seeks to provide face masks that allows others to identify the user. The present disclosure seeks to provide face masks that allow others to feel comfortable with the user. Further, a user may, in an exemplary usage of the present invention, utilize two facemasks of the present invention to cover the nose and the mouth, respectively, thus preventing respiratory spread between the user's mouth and nose.

Figure 2:
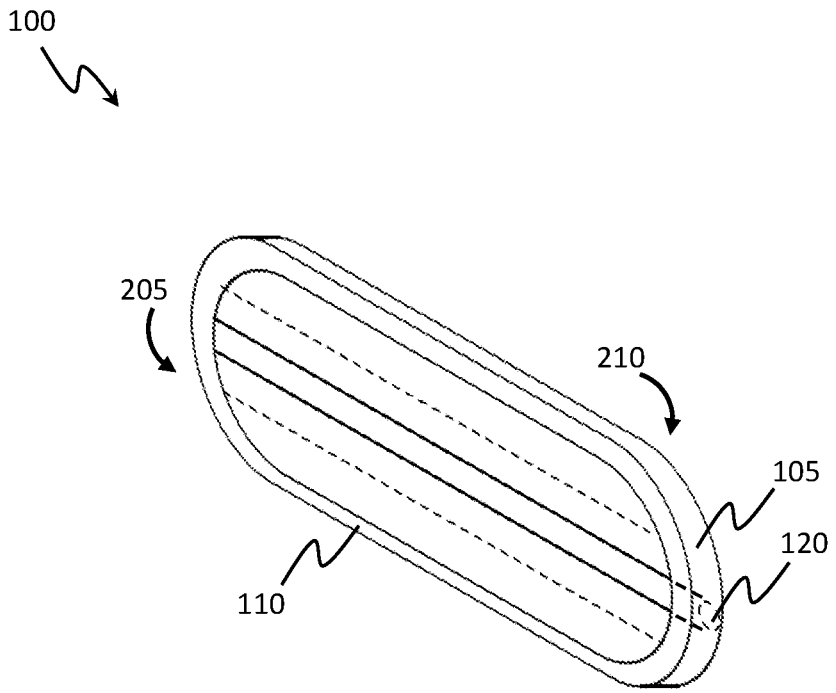
FIG. 2 illustrates a perspective view of the face mask of FIG. 1, according to other embodiments.
Figure 3:
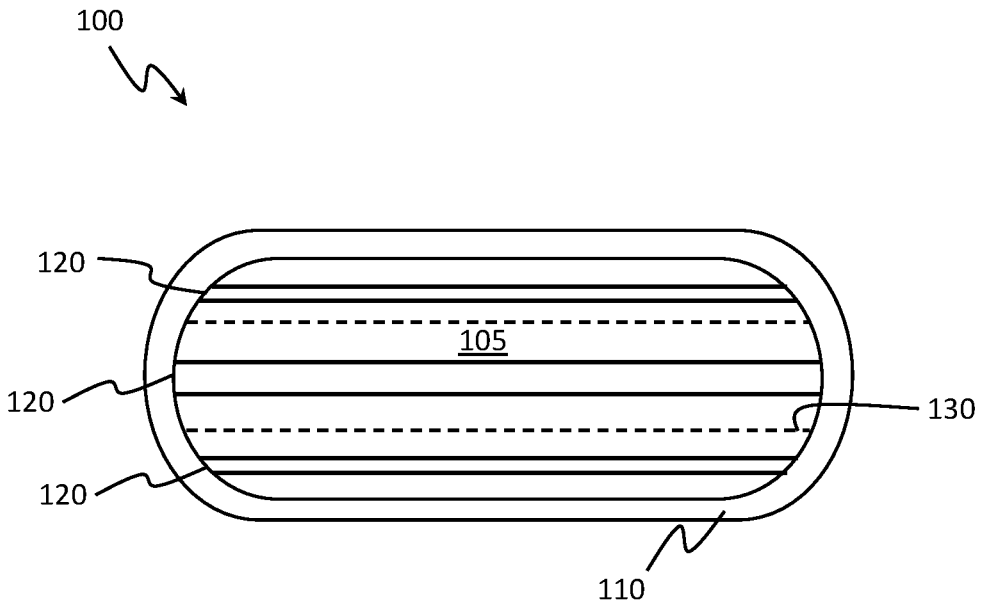
FIG. 3 illustrates a front view of a face mask having several support elements, according to certain embodiments.

FIGS. 1-5 are used herein to further clarify the advantages and features of the instant disclosure. FIG. 1 illustrate a front view of a face mask, generally 100, according to some embodiments. The face mask 100 is a strap-less mask that preferably covers a user's nose or mouth as opposed to face masks known in the art that cover both the user's nose and mouth. The face mask 100 includes a material layer 105 and an adhesive layer 110. The material layer 105 is a component that covers and is positioned proximate to the user's nose or mouth when worn. Hence, the material layer 105 allows air to pass through. Since the face mask 100 is worn on the user's face, it is important that the material layer 105 is hypoallergenic. As depicted in FIG. 2, the face mask 100 includes an internal surface 205 and an external surface 210. The internal surface 205 is oriented toward the user and the external surface is oriented away from the user when the face mask 100 is worn.

Although the material layer 105 can have any shape that facilitates one or more embodiments of the instant disclosure, the material layer 105 preferably has an oblong shape or a rectangular shape, which allows the face mask 100 to conform to the user's nose or mouth and maintain a seal therewith. In yet still other embodiments, the material layer 105 includes poly cotton blend material, 100% cotton material, polyester-cotton blend material, and/or cotton/polyester/rayon tri-blend material. The material layer 105 includes a coating, according to other embodiments. For example, the coating can include an anti-viral and/or an anti-bacterial substance, which increases the functionality of the face mask 100, allowing the user to operate in biohazardous environments, or assisting with the respiratory function for people with respiratory diseases and illnesses.

In certain embodiments, the material layer 105 is water repellant. For example, the material layer 105 can include GORE-TEX© or HydroShell™ material, which are both advanced waterproof technologies known in the art. In other embodiments, the material layer 105 is substantially transparent, which can aid in reading the user's lips when the face mask 100 is worn on the user's mouth. Here, the material layer 105 includes one or more polymers (e.g., thermoplastic polyurethane or similar transparent polymers). The adhesive layer 110 is positioned on the material layer 105. For example, the adhesive layer 110 can be coated on the material layer 105. The adhesive layer 110 is preferably present as a gap-less frame peripherally positioned about the material layer 105. For example, in embodiments where the material layer 105 is transparent, it can be fitted on to a frame, which includes the adhesive layer 110.

As depicted in FIGS. 1-4, the adhesive layer 110 allows users to wear the face mask 100 without the use of straps or similar coupling elements. The face mask 100 adheres to the nose or the mouth via the adhesive layer 110 and thereby creates a seal. As depicted in FIGS. 1-4, the face mask 100 includes a support element 120 that creates space between the user's nose or mouth (depending on where on the user's face the face mask 100 is worn) and the material layer 105, which increases the breathability and speakability (e.g., quality of speech when worn) of the face mask 100. The support element 120 preferably traverses the material layer 105. The support element 120 is preferably bendable and may be positioned within or on the material layer 105.

Figure 4:
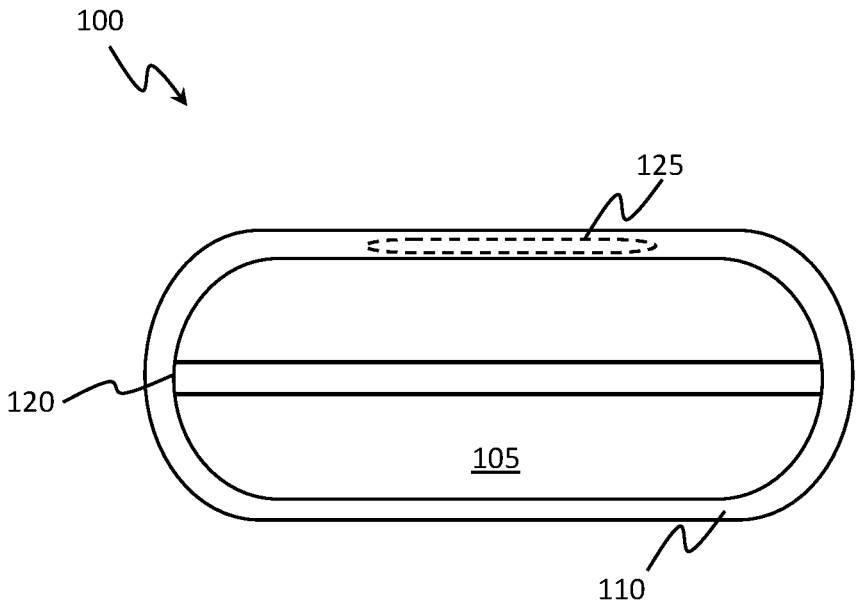
FIG. 4 illustrates a front view of a face mask having a support element and a nasal element, according to yet still other embodiments.
Figure 5:
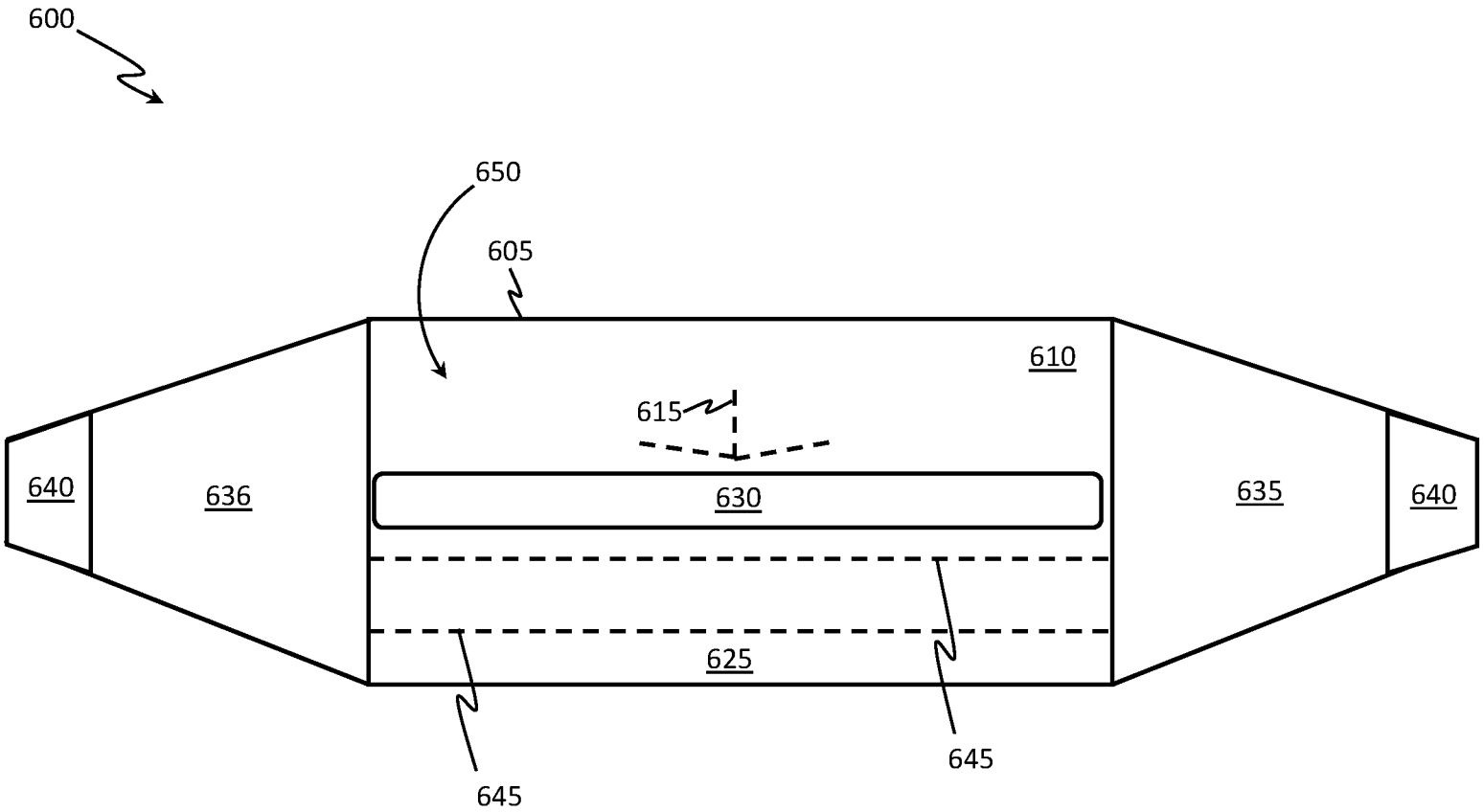
FIG. 5 illustrates a front view of a face mask, according to certain embodiments.

In embodiments where the face mask 100 is configured to be worn on the mouth, the material layer 105 is preferably pleated (i.e., includes pleats 130), which arguably assist users in speaking when wearing the face mask 100. FIG. 4 illustrates a front view of the face mask 100 that includes a support element 120 and a nasal element 125, according to yet still other embodiments. In embodiments where the face mask 100 is configured to be worn on the user's nose, the face mask 100 may not be pleated. The face mask 100 can include a nasal element 125, which is a plastically deformable strip of metal or other material, to allow the user to customize the shape of the portion of the periphery of the face mask 100 that extends across the bridge of the nose. After loosely fitting the face mask 100 over the nose, a user can plastically deform the nasal element 100 so as to help the face mask 100 maintain a close fit across the bridge of the nose. FIG. 5 illustrates a front view of the face mask 100.

Embodiments of the present disclosure further seeks to provide face masks that are demarcated between the nose and mouth areas of the face mask. Other aspects of the present invention seek to provide face masks that include a medicated nose area to treat the user without contaminating the user's mouth. The instant disclosure seeks to provide face masks that allows others to identify the user. The present disclosure seeks to provide face masks that allow others to feel comfortable with the user.

Figure 6:
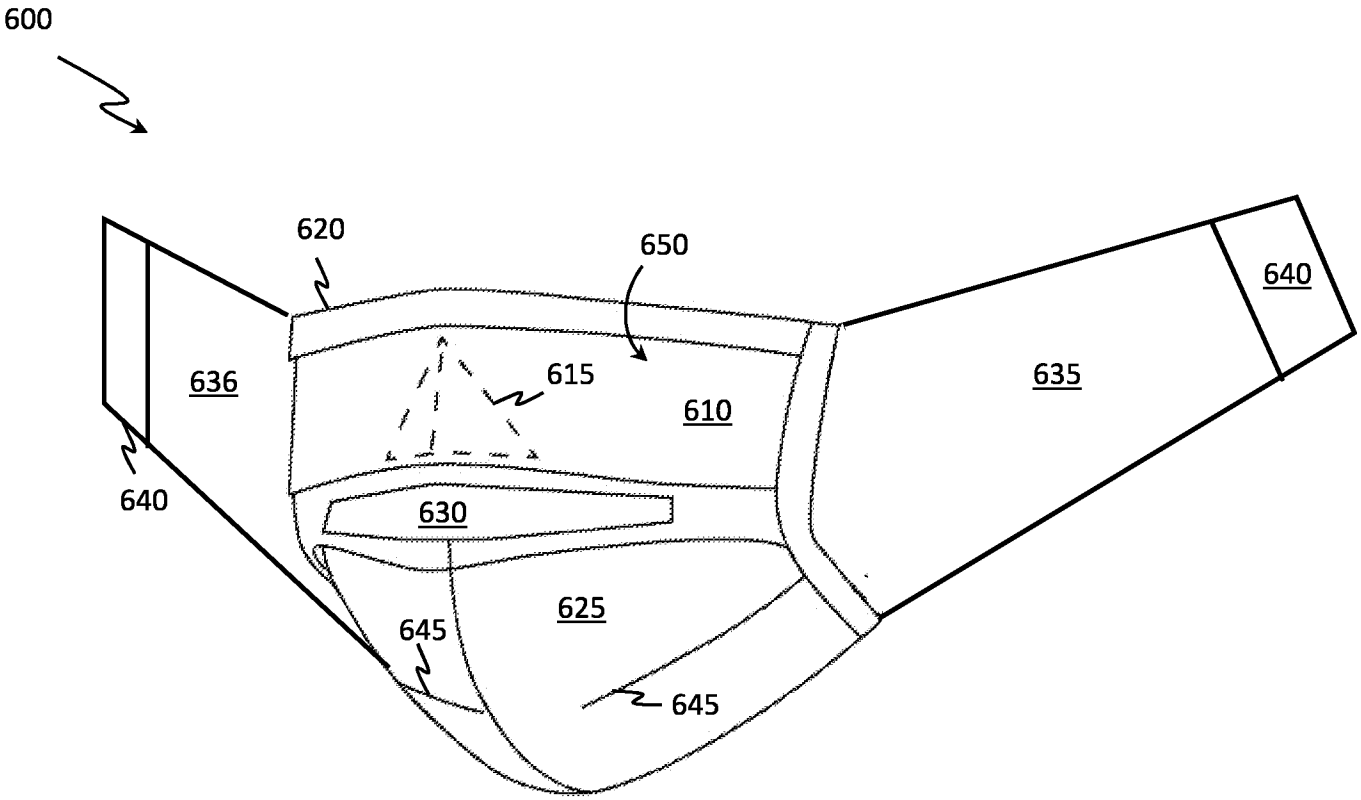
FIG. 6 illustrates a perspective view of the face mask of FIG. 6, according to other embodiments.
Figure 7:
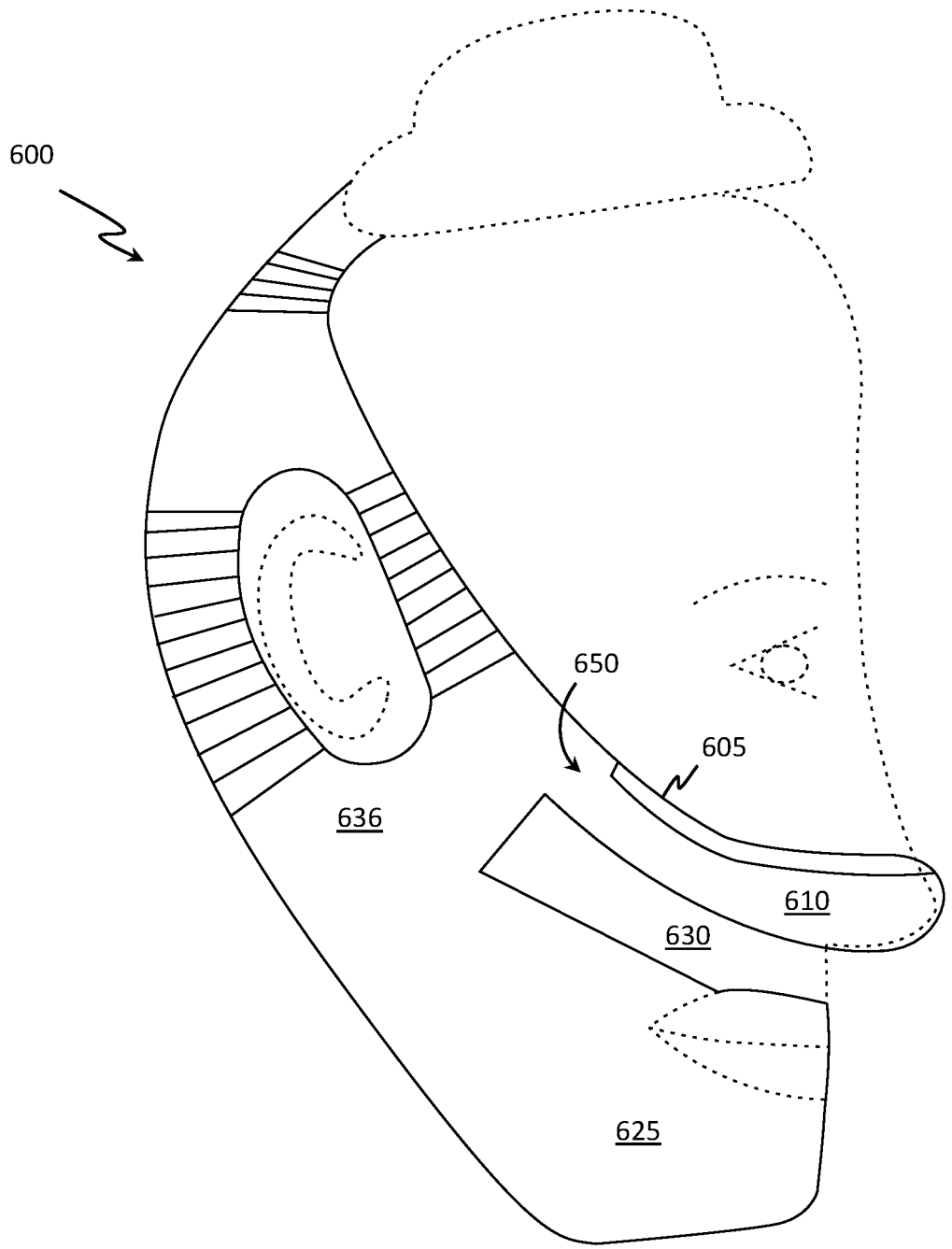
FIG. 7 illustrates a left perspective view of the face mask of FIG. 6, according to other embodiments.

FIGS. 5-7 are used herein to further clarify the advantages and features of the instant disclosure. FIG. 6 illustrates a front view of a face mask, generally 600, according to some embodiments. The face mask 600 is a demarcated, hypoallergenic, strapped face mask that covers a user's nose and mouth. The face mask 600 includes a main body 605, a first strap 635, and a second strap 636 that extend from the main body 605. In general, the main body 605 can have any shape that facilitates one or more embodiments of the instant disclosure. The main body 605 preferably has an oblong shape and/or a rectangular shape, which allows the face mask 600 to separately conform to the user's nose or mouth. In yet still other embodiments, the main body 605 and/or the first strap 635 and the second strap 636 include (i.e., are made of) poly cotton blend material, 100% cotton material, polyester-cotton blend material, cotton/polyester/rayon triblend material, or a combination of two or more thereof. In certain embodiments, the main body 605 and/or the first strap 635 and the second strap 636 are water repellant. For example, the main body 605 and/or the first strap 635 and the second strap 636 can be made with GORE-TEX© or Hydro-Shell™ material, which are waterproof technologies known in the art.

The main body 605 is a demarcated structure that includes an olfactory region 610, an oral region 625, and a void 630. In other words, the void 630 acts as a demarcation between the olfactory region 610 and the oral region 625. When the face mask 600 is worn, the olfactory region 610 covers the user's nose area and the oral region 625 covers the user's mouth area. The olfactory region 610 is coupled to the oral region 625. The olfactory region 610 is positioned proximate to and above the oral region 625. The olfactory region 610 is positioned adjacent to the void 630 opposite the oral region 625. The oral region 625 is positioned adjacent to the void 630 opposite the olfactory region 610. The olfactory region 610 preferably includes an olfactory component 615 that protrudes from the olfactory region 610 and receives the user's nose. In some embodiments, the olfactory region 610 includes a coating 650. For example, the coating 650 includes or is impregnated with a therapeutic agent(s) (e.g., anti-viral substances, antipathogenic substances, and/or an anti-bacterial substances), which increases the functionality of the face mask 600 (e.g., treatment of respiratory diseases). The main body 605 covers and is positioned proximate to the user's nose or mouth when the face mask 600 is worn. Hence, the main body 605 allows air to pass through. Since the face mask 600 is worn on the user's face, it is important that it is hypoallergenic and not cause discomfort.

In some embodiments, the olfactory region 610 includes a retaining element 620 positioned therein. The retaining element 620 is a non-metallic component that is selectively bendable to assume the shape of the user's nose and thereby secure the face mask 600 to the user's face. The retaining element 620 can be a flat strip or a round line. In some embodiments, the olfactory region 610 includes a coating 650 that is medicated. In other words, the coating 650 contains or is impregnated with one or more drugs or other therapeutic agents. For example, the coating 650 can include medicine for one or more respiratory illnesses (e.g., asthma, chronic obstructive pulmonary disease, chronic bronchitis, pneumonia, emphysema, pleural effusion, cystic fibrosis, and other respiratory illnesses). The oral region 625 preferably includes at least one pleat 645 that longitudinally extends along the oral region 625. The pleats 645 allow the oral region 625 to expand about the user's mouth region (e.g., which facilitates speech). The pleats 645 can be kick pleated or box pleated. The pleats 645 arguably assist users in speaking when wearing the face mask 600. The void 630 longitudinally extends along the main body 605.

The first strap 635 and the second strap 636 are used to demountably affix the face mask 600 to the user's face. Although the first strap 635 and the second strap 636 are depicted as having a polygonal planar shape, the first strap 635 and the second strap 636 can have any shape that facilitates an embodiment. In some embodiments, the first strap 635 and the second strap 636 each include an affixing component 640, which can be Velcro or other demountable fasteners (e.g., a clasp). The affixing components 640 demountably couple to each other. The first strap 635 and the second strap 636 can have any shape that facilitates one or more embodiments disclosed herein. The first strap 635 and the second strap 636 demountably couple to each other via their affixing components 640. For example, to wear the face mask 600, the first strap 635 and the second strap 636 are positioned below the user's ears and fastened behind the user's head via the affixing components 640 or are tied together.

Although the disclosure has been explained in relation to its preferred embodiment, it is to be understood that many other possible modifications and variations can be made without departing from the spirit and scope of the disclosure.

What is claimed is:

1. A face mask comprising:

a main body;

the main body comprising a material layer, an adhesive layer, an olfactory region, an oral region, a void and an olfactory component;

the adhesive layer being positioned on the material layer;

the adhesive layer being present as a frame peripherally positioned about the material layer;

the material layer allowing air to pass through;

the material layer comprises a poly cotton material;

the main body being configured to cover a nose area of a user and a mouth area of the user;

the main body being configured to adhere to the nose area and the mouth area via the adhesive layer and thereby creating a seal;

a support element;

the support element being positioned proximate to the material layer;

the support element traversing the material layer;

the material layer being pleated;

a first strap;

a second strap;

the first strap being connected adjacent to the material layer;

the second strap being connected adjacent to the material layer, opposite the first strap;

the void acting as a demarcation between the olfactory region and the oral region;

the olfactory region being configured to cover the nose area;

the oral region being configured to cover the mouth area;

the olfactory region being coupled to the oral region;

the olfactory region being positioned adjacent to the void opposite the oral region;

the oral region being positioned adjacent to the void opposite the olfactory region;

the void longitudinally extending along a majority of the length of the main body;

the olfactory component protruding from the olfactory region;

the olfactory component being configured to receive a nose of the user.

2. The face mask of claim 1, wherein the material layer comprises a coating; and the coating comprises an anti-viral or an anti-bacterial.

3. The face mask of claim 1, wherein the material layer comprises an oblong shape or a rectangular shape.

4. The face mask of claim 1, wherein the material layer is water repellant.

5. The face mask of claim 1, wherein the material layer is substantially transparent.

6. The face mask of claim 1, wherein the first strap and the second strap are each made of elastic material.

7. The face mask of claim 1, wherein the first strap and the second strap each comprise an affixing component.

8. The face mask of claim 1, wherein the first strap and the second strap tie together.

9. The face mask of claim 7, wherein the affixing component is a hook-and-loop fastener.

* * * * *